US012110566B2

(12) United States Patent
Shimotomai

(10) Patent No.: US 12,110,566 B2
(45) Date of Patent: Oct. 8, 2024

(54) STEEL MATERIAL AND METHOD FOR PRODUCING SAME

(71) Applicant: MOTP LLC, Chiba (JP)

(72) Inventor: Michio Shimotomai, Chiba (JP)

( * ) Notice: Subject to any disclaimer, the term of this patent is extended or adjusted under 35 U.S.C. 154(b) by 0 days.

(21) Appl. No.: 17/913,106

(22) PCT Filed: Mar. 10, 2021

(86) PCT No.: PCT/JP2021/009473

§ 371 (c)(1),
(2) Date: Sep. 20, 2022

(87) PCT Pub. No.: WO2021/193057

PCT Pub. Date: Sep. 30, 2021

(65) Prior Publication Data

US 2023/0127592 A1 Apr. 27, 2023

(30) Foreign Application Priority Data

Mar. 27, 2020 (JP) ..... 2020-057734

(51) Int. Cl.

| | |
|---|---|
| ***C21D 9/00*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/34*** | (2006.01) |
| ***C22C 38/38*** | (2006.01) |

(52) U.S. Cl.

CPC ..... *C21D 9/0081* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/34* (2013.01); *C22C 38/38* (2013.01); *C21D 2211/002* (2013.01); *C21D 2211/004* (2013.01); *C21D 2211/008* (2013.01); *C22C 2202/04* (2013.01)

(58) Field of Classification Search

CPC ..... C21D 2211/002; C21D 2211/004; C21D 2211/008; C21D 6/004; C21D 6/005; C21D 6/008; C21D 8/00; C21D 8/0205; C21D 8/0226; C21D 8/0236; C21D 8/0263; C21D 9/0081; C21D 9/46; C22C 2202/04; C22C 38/00; C22C 38/001; C22C 38/002; C22C 38/005; C22C 38/02; C22C 38/04; C22C 38/06; C22C 38/08; C22C 38/12; C22C 38/14; C22C 38/16; C22C 38/34; C22C 38/38; C22C 38/42; C22C 38/46; C22C 38/58

See application file for complete search history.

(56) References Cited

U.S. PATENT DOCUMENTS

| | | | | |
|---|---|---|---|---|
| 10,450,621 | B2 | 10/2019 | Abrahams | |
| 2014/0150934 | A1 | 6/2014 | Lee et al. | |
| 2018/0100212 | A1 | 4/2018 | Ono et al. | |
| 2018/0202019 | A1* | 7/2018 | Toda | C22C 38/04 |
| 2019/0330721 | A1* | 10/2019 | Hayashi | C22C 38/44 |

FOREIGN PATENT DOCUMENTS

| | | | |
|---|---|---|---|
| JP | 2004-043978 | A | 2/2004 |
| JP | 2006-206942 | A | 8/2006 |
| JP | 2013-104070 | A | 5/2013 |
| JP | 2014-525987 | A | 10/2014 |
| WO | WO 2016/152163 | A1 | 9/2016 |
| WO | WO 2017/009936 | A1 | 1/2017 |
| WO | WO 2018/055695 | A1 | 3/2018 |

OTHER PUBLICATIONS

ϵ carbide in Alloy Steels: First-principles Assessment Jae Hoon Jang Scripta Materialia 63 (2010) p. 121-123 (Year: 2010).*

M. Shimotomai, "Coherent-incoherent transition of in ϵ-carbide steels found with mechanical spectroscopy", Metall. Mater. Trans. A, 47A (2016), 1052-1060.

T.G.O. Berg, Douglas Aircraft Co. Engineering Paper No. 858, (1959). Revised in Quarterly Progress Report of Aerojet-General Co., 0253-5(18)QP. (1962).

W.C. Leslie, "The quench-aging of low-carbon iron and iron manganese alloys", Acta Metall, 9(1961), 1004-1022.

(Continued)

*Primary Examiner* — Jenny R Wu

(74) *Attorney, Agent, or Firm* — McGinn IP Law Group PLLC

(57) ABSTRACT

To provide a steel and a manufacturing method thereof that can contribute to achieving both high strength and hydrogen embrittlement resistance. The steel has a chemical composition represented by: C: 0.15% to 0.35%; Si: 0.8% to 2.5%; Mn: 0.8% to 2.5%; Al: 0.03% to 2.0%; N: 0.002% to 0.010%; P: 0.01% or less; S: 0.01% or less; O: 0.01% or less; B: 0.0001% to 0.005%; Nb: 0.0% to 0.05%; Ti: 0.0% to 0.2%; V 0.0% to 0.05%; Mo: 0.0% to 1.0%; Cr: 0.0% to 1.0%; Ni: 0.01% to 1.0%; Cu: 0.05% to 1.0%; at least one of Ca, Mg and REM: 0.0005% to 0.01%; and the balance: Fe and impurities, and has a martensite phase or/and a bainite phase in which ε-carbide is dispersedly precipitated.

8 Claims, 1 Drawing Sheet

(56) References Cited

OTHER PUBLICATIONS

N. Saito et al., (Effects of small addition of titanium, vanadium and chromium on the kinetics of ϵ-carbide precipitation in high purity Fe—C alloys, Materials Transactions JIM, 36(1995), 601-609.
W.C. Leslie et al., Solutions and precipitation of aluminum nitride in relation to the structure of low carbon steels », Transactions of ASM, 46(1954), p. 1470-1499.
Y. Tomio et al., "Plasma nitriding behavior of Fe—C—M (M=Al, Cr, Mn, Si) ternary martensitic steels", Metall. Mater. Trans. A, 45A (2014), 239-249.
Toji, Y. et al., "Evaluation of Hydrogen Embrittlement for High Strength Steels Sheets", Tetsu-to-Hagane, the Iron and Steel Institute of Japan vol. 95 (2009), 887-894.
T.G.O. Berg, Hydrogen in Carbide in Steel. In Proceedings of the 61$^{st}$ Annual Meeting, American Ceraminc Society, May 17-21, 1959; Ceramic Bulletin, Am. Ceramic Soc.: 1961; vol. 40, pp. 78-80.
Shimotomai, "Heuristic Design of Advanced Martensitic Steels That Are Highly Resistant to Hydrogen Embrittlement by ϵ-carbide" Metals 2021, 11,370.
Written Opinion of the International Searching Authority (PCT Form PCT/ISA/237), in PCT/JP2021/009473, dated May 13, 2021.
International Search Report (ISR) (PCT Form PCT/ISA/210), in PCT/JP2021/009473, dated Jun. 1, 2021.

* cited by examiner

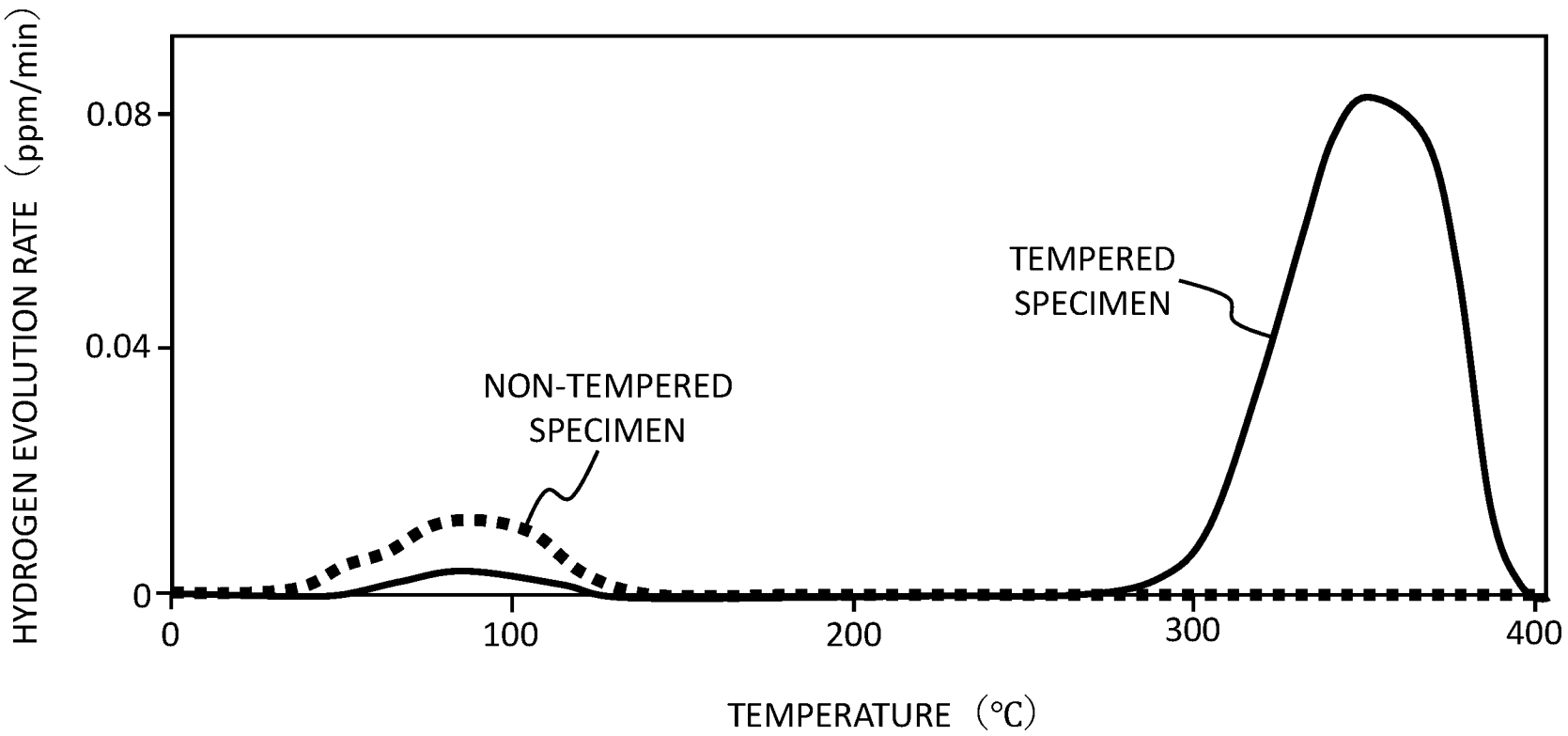
TEMPERED SPECIMEN
NON-TEMPERED SPECIMEN
0.08
0.04
0
HYDROGEN EVOLUTION RATE (ppm/min)
0
100
200
300
400
TEMPERATURE (°C)

STEEL MATERIAL AND METHOD FOR PRODUCING SAME

FIELD

The present invention relates to a steel and a manufacturing method thereof, the steel being suitable for vehicles, building materials, machine parts, home electric appliances, hydrogen storage stations, high-strength bolts, and the like.

BACKGROUND

Reference to Related Application

The present invention is based on a priority claim of Japanese Patent Application No. 2020-57734 (filed on Mar. 27, 2020), and all contents in the said application are regarded incorporated and described herein by reference.

From the viewpoints of weight reduction of vehicle body parts, reduction of construction cost, response to global environmental problems, etc., it is required to further increase the strength of steels and to improve their hydrogen embrittlement resistance characteristic [*]. In the fields of industrial machinery, tanks, line pipes, etc., the strength of steels is becoming higher, and their usage environment is becoming harsher. It is recognized that as the strength of steels is becoming higher and their usage environment is becoming harsher the requirement for the hydrogen embrittlement susceptibility (HE susceptibility) [*] of steels will be harsher. Therefore, development of steels with high strength compatible with excellent hydrogen embrittlement resistance characteristic has been required.

[* Translator's Note: The term "hydrogen embrittlement susceptibility" is the inverse notion of the term "hydrogen embrittlement resistance". Thus, high hydrogen embrittlement resistance corresponds to low hydrogen embrittlement susceptibility. After drafting the original Japanese application, the inventor was notified that the term "hydrogen embrittlement susceptibility" will be used in the academic society instead of "hydrogen embrittlement resistance". The term "hydrogen embrittlement resistance" is used in this translation. In the translation, the terms within brackets [ ] are added by the translator for better understanding within the original disclosure.]

Against such backgrounds, Patent Literature references, PTL1 and PTL2 disclose techniques for increasing the strength of steels and steel sheets and for improving the hydrogen embrittlement resistance characteristics thereof by optimizing chemical composition, controlling precipitation of carbides, and by optimizing heat treatment. Also, PTL3 discloses a world-first technique for increasing the strength and toughness of a low alloy steel by dispersed precipitates of ε-carbide. Further, PTL4 discloses a steel sheet which is excellent in every respect such as tensile strength, ductility, pore expandability, hydrogen embrittlement resistance characteristic and toughness by optimizing its chemical composition, refining the grain size, controlling its microstructure, and by trapping hydrogen atoms at finely dispersed various carbides. Furthermore, PTL5 discloses the idea of the use a high-strength bolt to improve the hydrogen delayed fracture by precipitating LaNi5 in a steel by alloying it with the rare earth metal (REM) Lanthanum (La). The intermetallic compound traps and fixes hydrogen atoms entering from the exterior inside the steel.

[PTL1] JP2004-43978A
[PTL2] JP2006-206942A
[PTL3] U.S. Pat. No. 10,450,621B

[PTL4] WO2018/055695A1
[PTL5] JP2014-525987A
[NPL1] M. Shimotomai, "Coherent-incoherent transition of E-carbide in steels found with mechanical spectroscopy", Metall. Mater. Trans. A, 47A (2016), 1052-1060.
[NPL2] T.G.O. Berg, Douglas Aircraft Co. Engineering Paper No. 858, (1959). Revised in Quarterly Progress Report of Aerojet-General Co., 0253-05 (18) QP, (1962).
[NPL3] W. C. Leslie, "The quench-aging of low-carbon iron and iron-manganese alloys", Acta Metall., 9 (1961), 1004-1022.
[NPL4] N. Saito et al., "Effects of small addition of titanium, vanadium and chromium on the kinetics of &-carbide precipitation in high purity Fe—C alloys", Materials Transactions JIM, 36 (1995), 601-609.
[NPL5] W. C. Leslie et al., "Solution and precipitation of aluminum nitride in relation to the structure of low carbon steels", Transactions of ASM, 46 (1954), p. 1470-1499.
[NPL6] Y. Tomio et al., "Plasma nitriding behavior of Fe—C—M (M=Al, Cr, Mn, Si) ternary martensitic steels", Metall. Mater. Trans. A, 45A (2014), 239-249.
[NPL7] Yuki Taji et al., "Evaluation of hydrogen embrittlement for high strength steel sheets", Tetsu-to-Hagané, 95 (2009), 887-894.
[NPL8] T.G.O. Berg, Hydrogen in Carbide in Steel. In Proceedings of the 61st Annual Meeting, American Ceramic Society, 17-21 May 1959; Ceramic Bulletin, Am. Ceramic Soc.: 1961; Volume 40, pp. 78-80.

SUMMARY

The following analysis is given by the inventor of the present application.

However, in the techniques described in PTL1 to PTL5, it is difficult or insufficient to achieve both high strength and hydrogen embrittlement resistance characteristic. Thus, for example, a high strength steel sheet having a tensile strength of 1180 MPa or more has been applied around the cabin of a passenger vehicle. However, delayed fracture is considered liable to take place during its use. Also, the use of high-strength bolts for vehicles has been limited to high-strength bolts of 1200 MPa or less only because of these being a risk of breakage due to hydrogen embrittlement. In PTL3, the manufacturing cost is high because expensive alloying elements are required. Furthermore, no consideration is given to [enhancing] the hydrogen embrittlement [resistance].

It is a main object of the present invention to provide a steel and a manufacturing method thereof that can contribute to achieving both high strength and hydrogen embrittlement resistance characteristic.

A steel according to the first aspect has a chemical composition represented by: in mass %, C: 0.15% to 0.35%; Si: 0.8% to 2.5%; Mn: 0.8% to 2.5%; Al: 0.03% to 2.0%; N: 0.002% to 0.010%; P: 0.01% or less; S: 0.01% or less; O: 0.01% or less; B: 0.0001% to 0.005%; Nb: 0.0% to 0.05%; Ti: 0.0% to 0.2%; V: 0.0% to 0.05%; Mo: 0.0% to 1.0%; Cr: 0.0% to 1.0%; Ni: 0.01% to 1.0%; Cu: 0.05% to 1.0%; at least one of Ca, Mg and REM: 0.0005% to 0.01%; and the balance: Fe and impurities, wherein the steel has a martensite phase or/and a bainite phase in which &-carbide having a size of 2 nm to 150 nm is dispersedly precipitated at a density of $1\times10^6$ or more per 1 $mm^2$. The ε-carbide is configured to stably occlude hydrogen inside crystals thereof.

A manufacturing method for a steel according to the second aspect is a method of manufacturing the steel according to the first aspect, wherein the method comprises: a step of dispersedly precipitating aluminum nitride in a martensite phase or/and a bainite phase upon cooling the steel after hot rolling to ambient temperature, in such a manner that the martensite phase or/and the bainite phase is formed; and thereafter, a step of precipitating ε-carbide by tempering the steel at 100° C. or higher and less than 300° C. using the aluminum nitride as nucleation sites. The chemical composition has a ratio of Al to N in mass % of more than 7. The ε-carbide is formed in a state such that hydrogen is stably occluded inside crystals thereof in a temperature range of less than 300° C.

The first and second aspects can contribute to achieving both high strength and hydrogen embrittlement resistance characteristic.

BRIEF DESCRIPTION OF DRAWINGS

FIG. 1 is a graph showing temperature dependence of hydrogen evolution rates of tempered and non-tempered specimens.

PREFERRED MODES

Modes

The inventor of the present application studied the precipitation process of ε-carbide in iron-carbon alloy systems from an atomistic standpoint to solve the above problem. The inventor noticed the fact that the solid solubility of nitrogen [in the martensite phase and/or bainite phase] is reduced to the 10% or less [of that in the parent austenite phase] upon formation of the martensite phase and/or bainite phase (which corresponds to upon transformation from the austenite phase to the martensite phase and/or bainite phase) (NPL5). The inventor has found that this fact might be utilized to form a microstructure in which the aluminum nitride phase is finely dispersedly precipitated. Further in the subsequent tempering stage, these dispersed precipitates might act as the nucleation sites (inoculants) for ε-carbide to precipitate. Here, both aluminum nitride and ε-carbide belong to a hexagonal crystalline system, and their lattice parameters have a relationship that enables a formation of a semi-coherent interface between them. By various tests on steels with finely dispersed precipitates of ε-carbide, the inventor of the present application has found that high strength and extremely excellent hydrogen embrittlement resistance characteristic are compatible. Based on these findings combined with diligent consideration, the inventor of the present application has reached the present disclosure shown below.

Here, the inventor of the present application studied basic physical properties of ε-carbide in Fe—C alloy systems, which had been overlooked so far for the reason that the ε-carbide was considered as being a mere transient carbide, by using a method of frequency-sweep mechanical spectroscopy and published a paper (NPL1). The study has revealed that the ε-carbide in steels has a lattice structure containing many carbon vacancy sites and has a common feature with a material group known as hydrogen occluding materials. Crediting the report that an experiment was conducted to test a hypothesis that ε-carbide could occlude hydrogen up to a composition of $Fe_2CH$ (NPL2), it is inferred that hydrogen will occupy carbon vacancy sites in ε-carbide. It has been pointed out in NPL3 that ε-carbide dispersedly precipitated in the ferrite phase can improve the strength by a particle dispersion mechanism. Also, NPL4 has shown that ε-carbide can start nucleation at TiC precipitates in a rapidly cooled Fe—C—Ti alloy. In the prior art, ε-carbide had been described merely as an additional carbide at the end of a group of iron carbides, and its functions and actual precipitation conditions have been neglected. There has been no idea whatsoever suggesting the use of the ε-carbide as a material that occludes (absorbs and stores) hydrogen atoms that have intruded into steels.

No steel with high strength compatible with hydrogen embrittlement resistance characteristic has ever been developed by utilizing dispersed precipitates of ε-carbide in a microstructure consisting mainly of a martensite phase or/and a bainite phase.

In the present disclosure described below, a steel according to the following mode 1 and modified modes thereof can be appropriately selected and combined.

As a steel according to the above mode 1, a steel is possible in which the steel has a chemical composition represented by:

in mass %,
C: 0.15% to 0.35%,
Si: 0.8% to 2.5%,
Mn: 0.8% to 2.5%,
Al: 0.03% to 2.0%,
N: 0.002% to 0.010%,
P: 0.01% or less,
S: 0.01% or less,
O: 0.01% or less,
B: 0.0001% to 0.005%,
Nb: 0.0% to 0.05%,
Ti: 0.0% to 0.2%,
V: 0.0% to 0.05%,
Mo: 0.0% to 1.0%,
Cr: 0.0% to 1.0%,
Ni: 0.01% to 1.0%,
Cu: 0.05% to 1.0%,
at least one of Ca, Mg and REM: 0.0005% to 0.01%, and,
the balance: Fe and impurities,
wherein the steel has a martensite phase or/and a bainite phase in which ε-carbide having a size of 2 nm to 150 nm is dispersedly precipitated at a density of $1\times10^6$ or more per 1 $mm^2$. In the following, unless otherwise noted, "mass %" is simply expressed as "%".

Here, C (carbon) is an essential element that: not only enables phase transformation of the steel; but also improves the strength characteristic and the hydrogen embrittlement resistance characteristic of the steel by the precipitation of ε-carbide. To obtain such effects, the content of C needs to be 0.15% or more, preferably 0.17% or more, and more preferably 0.2% or more. On the other hand, if the content of C exceeds 0.35%, the toughness and weldability of the steel are significantly reduced, so the content of C needs to be 0.35% or less, preferably 0.32% or less, and more preferably 0.3% or less. Although the ε-carbide has a hexagonal crystal structure and its composition is expressed as $Fe_{2.4}C$ in textbooks of steels, here, it is expressed as typically (or essentially) $Fe_{2.4}C$, or $Fe_{2.4\text{-}2.7}C$ in consideration of the non-stoichiometric nature.

Si (silicon) dissolves in solid steels to form a solid solution and contributes to improving the strength and has the effect of expanding the stable existence range of ε-carbide to higher temperatures. To obtain such an effect, the content of Si needs to be 0.8% or more, preferably 1.0% or more, and more preferably 1.2% or more. On the other hand, if the content of Si exceeds 2.5%, the rolling load increases, so that the content of Si needs to be 2.5% or less, preferably 2.3% or less, and more preferably 2.0% or less.

Mn (manganese) dissolves in solid steels to form a solid solution and contributes to strengthening it. It suppresses a transformation to a ferrite phase during cooling [inducing martensitic transformation] and lowers the Ms point (a temperature at which the transformation to the martensite phase starts during quenching). To obtain such effects, a content of Mn needs to be 0.8% or more, preferably 1.0% or more, and more preferably 1.2% or more. On the other hand, if the content of Mn exceeds 2.5%, a weldability will deteriorate. Thus, the content of Mn needs to be 2.5% or less, preferably 2.3% or less, and more preferably 2.0% or less.

Al (aluminum) is a useful element used as a deoxidizer during steelmaking. Al atoms dissolved in the steel react with N atoms, which are also dissolved, during or after the transformation from the austenite phase to the martensite phase or/and bainite phase. [During this transformation from the austenite into the martensite phase most of the N atoms are squeezed out owing to solubility difference associated with the phase change.] The Al atoms [reacted with "free" N atoms] give rise to fine precipitates of aluminum nitride (AlN) inside laths and/or along dislocations in the martensite or/and bainite. Their shape is reported to be plate-shaped or rod-shaped (NPL6). In the tempering process of the steel, the fine precipitates of AlN can act as nucleation sites for ε-carbide to precipitate. The content of Al is 0.03% or more, preferably 0.04% or more, and more preferably 0.05% or more to fix the N atoms as aluminum nitride. If the content of Al exceeds 2.0%, the density of inclusions in the steel increases and the ductility will decrease. Accordingly, the content of Al needs to be 2.0% or less, preferably 1.8% or less, and more preferably 1.5% or less. For fine dispersed precipitates of AlN, it is desirable that the ratio "Al/N" of Al and N in mass % be larger than 7, considering the difference between the diffusional mobilities of Al atoms and N atoms in the martensite phase or/and bainite phase. [This will be referred to again at [0021] and [0035]].

N (nitrogen atom) is an essential element that forms aluminum nitride. Existent as a solid solution in the steel, it lowers its toughness, so that it is preferable to reduce the content. It is known that the solid solubility of N [in a martensite phase or/and a bainite phase] is decreased below one tenth of that in austenite by (upon) the transformation from an austenite phase to a martensite phase or/and a bainite phase (NPL5). NPL6 reports that N reacts with Al to form fine and dispersed aluminum nitride precipitates in a martensite phase. From a viewpoint of the production cost of the steel, the content of N can be 0.002% or more, may be 0.003% or more, and further may be 0.004% or more. On the other hand, from a viewpoint of preventing the strength variation, the content of N should be 0.010% or less, preferably 0.008% or less, and more preferably 0.006% or less.

P (phosphorus) is an element that segregates at grain boundaries of the steel resulting in a weakening of its grain boundary strength and a lowering of its delayed fracture resistance characteristic. Although, it is desirable to reduce the content of P as much as possible, a content of up to 0.01% may be acceptable, preferably 0.005% or less, and more preferably up to 0.001% or less.

S (sulfur) is an element that produces MnS in the steel which might act as a starting point of delayed fracture. Therefore, it is desirable to reduce a content of S as much as possible. A content up to 0.01% may be acceptable, preferably 0.005% or less, and more preferably 0.001% or less.

O (oxygen atom) is an element that combines with other elements to form various oxides which cause deterioration of steel formability and toughness. Therefore, it is desirable to reduce the content of O as much as possible. However, a content of up to 0.01% may be acceptable, preferably 0.005% or less, and more preferably up to 0.001% or less.

B (boron) is an element that segregates at the grain boundaries of the steel resulting in an increase of its grain boundary strength and an improvement of its toughness and delayed fracture resistance characteristic. The element is known to significantly improve the hardenability. To obtain such effects, the content of B is desirably 0.0001% or more, preferably 0.0005% or more, and more preferably 0.001% or more. On the other hand, if the content of B exceeds 0.005%, it precipitates as a boride and the toughness is lowered. The content of B needs to be 0.005% or less, preferably 0.003% or less, and more preferably 0.002% or less.

Nb (niobium), Ti (titanium) and V (vanadium) are elements that precipitate in the forms of their respective carbonitrides during tempering of steels. These carbonitrides are stable up to higher temperatures than that of ε-carbide. They contribute to an improvement in strength at high temperatures. Although the presence of these elements as steel constituents is not necessary, at least one of the elements may be added if necessary. The content of each of Nb, Ti and V may be 0.0% or more, whereas the content of each of Nb, Ti and V is preferably 0.001% or more, and more preferably 0.005% or more, to obtain an effect in improving the strength. If the content of either Nb and V exceeds 0.05%, the toughness of the weldment decreases and moreover the cost of the raw materials (rare metals) rises. Accordingly, the contents of Nb and V need to be 0.05% or less, preferably 0.04% or less, and more preferably 0.03% or less. A Ti content of up to 0.2% may be acceptable. From the viewpoint of the weldability, it is preferably 0.18% or less, and more preferably 0.15% or less.

Mo (molybdenum) and Cr (chromium) are elements that dissolve in steels to form solid solutions which contributes to an improvement in strength and to suppressing the ferrite transformation during cooling and improve the hardenability. Mo and Cr form complex carbonitrides during the formation of respective carbonitrides of Nb, Ti or V. Although Mo and Cr do not necessarily have to be contained, at least one of Mo and Cr may be added if necessary. The contents of Mo and Cr may be 0.0% or more. To obtain the effect of improving the strength, the respective contents of Mo and Cr are preferably 0.01% or more, and more preferably 0.02% or more. If the respective contents of Mo and Cr exceed 1.0%, manufacturability in the hot rolling process decreases. Accordingly the respective contents of Mo and Cr are set to 1.0% or less, preferably 0.8% or less, and preferably 0.5% or less from a viewpoint of cost.

Ni (nickel) is an element that stabilizes austenite phase. It suppresses hydrogen intrusion in steels and is effective in improving the delayed fracture resistance characteristic. To obtain these effects, the content of Ni is set to 0.01% or more, preferably 0.02% or more, and more preferably 0.05% or more. On the other hand, if the content exceeds 1.0%, not only these effects will be maximally fulfilled but manufacturing costs will increase. The content of Ni is desirably 1.0% or less, preferably 0.8% or less, and more preferably 0.5% or less.

Cu (copper) is an element that has the effect of suppressing hydrogen intrusion into steels and thus also the effect of improving the delayed fracture resistance characteristic. To obtain such effects, a content of Cu needs to be 0.05% or more, preferably 0.08% or more, and more preferably 0.1% or more. If the content of Cu exceeds 1.0%, manufacturability in the hot-rolling process decreases, so that the content of Cu is set to 1.0% or less, preferably 0.8% or less, and more preferably 0.5% or less.

Ca (calcium), Mg (magnesium) and REM (Rare Earth Metals: Sc, Y, La, Ce, Pr, Nd, Sm, Eu, Gd, Tb, Dy, Ho, Er, Tm, Yb, Lu) are elements that have an affinity for S stronger than that of Mn. Therefore, they form sulfides in steels and contribute to a reduction of MnS which tends to be a starting point of delayed fracture. Accordingly Ca, Mg or REM, or an arbitrary combination of these may be included. To obtain such an effect, a total content of respective contents of Ca, Mg and REM needs to be 0.0005% or more, preferably 0.001% or more, and more preferably 0.002% or more. On the other hand, if the total content of Ca, Mg and REM exceeds 0.01%, a cleanliness of the steel is lowered [i.e., the density of inclusions is increased], so that the total content of Ca, Mg and REM needs to be 0.01% or less, preferably 0.008% or less, and more preferably 0.005% or less.

The balance is Fe and impurities (unavoidable impurities). However, if it is within a range in which the effects of present invention are not impaired, the presence as constituents of element(s) other than the above is not deprecated.

Here, if an appropriate cooling rate (speed) [in the transformation step from the austenite phase] is selected, ε-carbide will precipitate in the tempering step by nucleation taking place at the aluminum nitride which has precipitated during or after the transformation to martensite phase or/and bainite phase. As a result, a steel will be produced in which [precipitates of]hexagonal ε-carbide with a size of 2 nm or more and 150 nm or less are dispersedly precipitated in the martensite phase or/and the bainite phase at a density of $1\times10^6$ or more per 1 $mm^2$. Since the pre-precipitated aluminum nitride is used as the nucleation sites, ε-carbide can be controlled to the above-mentioned density. The size can be controlled by adjusting the tempering temperature and time. The finely dispersedly precipitated ε-carbides contribute to an improvement in strength and ductility by the particle dispersion mechanism disclosed in NPL3.

Also here, as regards the hydrogen embrittlement resistance characteristic, ε-carbide has a crystal structure that can occlude a large amount of hydrogen (NPLs 1 and 2), and consequently the hydrogen storage amount is significantly larger than the amount of hydrogen captured at the interfaces between the usual host iron matrix and the carbonitrides. Accordingly, the hydrogen embrittlement resistance characteristic of the steel is dramatically improved. In this case it does not matter whether the interface between the ε-carbide and the host crystal is coherent or incoherent. In the C-carbide, a part of Fe atoms may be replaced with other element(s) such as Si, Al, Mn, Cr, etc. Further, a part of carbon atoms may be replaced by nitrogen atoms. The size and distribution of ε-carbide can be observed using a scanning electron microscope, a transmission electron microscope, or the like. Mechanical spectroscopy is useful for detecting small ε-carbides in an early stage of the precipitation. The density of ε-carbides having a size of 2 nm or more and 150 nm or less per 1 $mm^2$ is required to be $1\times10^6$ or more, preferably $2\times10^6$ or more, and more preferably $5\times10^6$ or more. The cooling rate for the steel is referred in a later section.

As a modified mode of the steel according to the mode 1, at least one of the Nb, the Ti and the V may be contained, and at least one of the Mo and the Cr may be contained. At least one of Mo and Cr forms a complex carbonitride during the formation of a carbonitride of at least one of Nb, Ti and V.

As a modified mode of the steel according to the mode 1, aluminum nitride may be contained (incorporated or absorbed) in the ε-carbide. More specifically during the growth of the ε-carbide, the aluminum nitride may dissolve and vanish in the ε-carbide or be present as a solid solution, dispersed or diffused in the ε-carbide.

As a modified mode of the steel according to the mode 1, the ratio of Al to N in mass % may be greater than 7. Since Al atoms show slower diffusional mobility compared to N atoms in the martensite phase or/and bainite phase, this ratio is to provide effective encounters of Al and N atoms to thereby promote the effective nucleation for fine and dispersed precipitates of aluminum nitride. The ratio of Al to N in mass % may be preferably 8 or more, and more preferably 10 or more.

As a modified mode of the steel according to the mode 1, the martensite phase or/and the bainite phase in the microstructure may be limited to 70% or more and less than 90% in volume fraction.

As a modified mode of the steel according to the above mode 1, in volume fraction, the residual austenite phase may exist at 5% or more and less than 30%, and other phase(s) including at least ferrite phase may exist at less than 20%.

Here, when a steel having a chemical composition such as the steel according to the mode 1 is rapidly cooled from the austenite phase region in the phase diagram at a cooling rate of 0.1° C./s to 200° C./s, during or after the phase transformation, a steel having martensite phase or/and bainite phase as the main phase structure, in which aluminum nitride is finely dispersedly precipitated, can be obtained. Then, when tempered in a range of 100° C. to 300° C., a steel is obtained, in which the martensite phase or/and the bainite phase is 70% or more and less than 90% in volume fraction, the residual austenite phase is 5% or more and less than 30%, and other phases including the ferrite phase is less than 20%. The volume of each phase may be evaluated with electron microscopic observations or/and X-ray diffraction measurements. The volume fraction of the main phase depends on the cooling rate of the steel and specifically on the local cooling rate. It is necessary that the martensite phase or/and the bainite phase be 70% or more and less than 90% to achieve both high strength and hydrogen embrittlement resistance characteristic.

As a modified mode of the steel according to the mode 1, the yield strength can be 1000 MPa or more. The yield strength is preferably 1100 MPa or more, and more preferably 1200 MPa or more.

As a modified mode of the steel according to the mode 1, the tensile strength can be 1200 MPa or more. The tensile strength is preferably 1300 MPa or more, and more preferably 1400 MPa or more.

As a modified mode of the steel according to the mode 1, the elongation can be 12% or more. The elongation is preferably 13% or more, and more preferably 15% or more.

As a modified mode of the steel according to the mode 1, when a strip-shaped test piece that has been bent U-shaped is immersed in a 0.1% ammonium thiocyanate solution for at least 100 hours, the end-faces along [the U-shaped part of] the test piece do not show any fractures (surface microcrack). It is preferable that the end faces of the test piece do not reveal fractures when the test piece is immersed for at least 300 hours. More preferably the end faces of the test piece are not fractured at all when the test piece is immersed for at least 500 hours.

In the present disclosure, a manufacturing method of a steel according to the mode 2 which will be described below, and modified modes thereof can be appropriately selected and combined.

As a manufacturing method of a steel which shall be called as mode 2, a method of manufacturing the steel according to the claim [sic., mode] 1 is possible, wherein the method comprises: a step of dispersedly precipitating aluminum nitride in a martensite phase or/and a bainite phase produced upon cooling the steel after the preceding hot-rolling step to ambient temperature, and a step of growing ε-carbide nucleated at aluminum nitride precipitates by tempering the cooled steel in a range of 100° C. or more and less-than 300° C.

As a modified mode of the method according to the mode 2, in the step of growing the ε-carbide, it is possible that the ε-carbide having a size of 2 nm or more and 150 nm or less is dispersedly precipitated in the martensite phase or/and the bainite phase at a density of $1\times10^6$ or more per 1 $mm^2$.

As a modified mode of the method according to the mode 2, in the step of dispersedly precipitating the aluminum nitride, the cooling rate may be 0.1° C./s to 200° C./s.

Here, whereas the method according to the mode 2 comprises: the step of dispersedly precipitating aluminum nitride; and the step of tempering, as a whole, the method may be done, for example, in the order of the steps of melting; hot-rolling; cold-rolling; continuous annealing; cooling (corresponding to forming the martensite phase or/and the bainite phase and to dispersedly precipitating aluminum nitride); and tempering (corresponding to nucleation and growth of ε-carbide).

First, in the melting step, for example, a slab with the chemical composition according to the mode 1 is produced by the continuous casting method or the ingot-making method.

In the next hot rolling step, for example, the slab prepared in the melting step may be immediately hot-rolled or the slab once cooled to ambient temperature is reheated and is subjected to the hot-rolling, thereby a hot-rolled plate (hot-rolled steel) is produced. In the hot-rolling step, it is possible to roll directly after casting. In the case where the slab is once cooled to room temperature and then reheated, it is usual to heat the slab up to 1150° C. or higher for one hour before the hot rolling is performed. A finishing temperature should be 950° C. or higher. After the finish rolling, the hot-rolled steel sheet is cooled to about 600° C. at an average cooling rate of 30° C./s or higher, and then is coiled.

In the next cold-rolling step, for example, the above hot-rolled sheet is cold-rolled to produce a cold-rolled sheet (cold-rolled steel) with a predetermined thickness. The rolling reduction ratio should be 30% or more. If the rolling reduction ratio is less than 30%, austenite grains will become coarsened in the subsequent annealing step, whereby the average block diameter of the martensite phase or the bainite phase in the steel sheet may not be 5 μm or less.

In the next continuous annealing step, for example, the obtained cold-rolled sheet is continuously annealed to produce an annealed sheet (annealed steel). The continuous annealing is preferably performed on a continuous annealing line. In the continuous annealing step, the cold rolled sheet is heated to a temperature range of $Ae_3$ points minus 10° C. or higher and 920° C. or lower and held for 120 seconds or longer. When the heating and holding temperature is lower than $Ae_3$ point minus 10° C., the volume fraction of the martensite phase or/and the bainite phase becomes less than 70%, resulting in the deteriorations of the mechanical strength and hydrogen embrittlement resistance characteristic. On the other hand, if the heating and holding temperature exceeds 920° C., the austenite grains may be coarsened, whereby the average block diameter of the tempered martensite phase or/and bainite phase may not be 5 μm or less. In the case of a small amount of cold rolled sheet, batch annealing may be used.

In the next cooling step, for example, the annealed sheet is cooled to a temperature ranging from room temperature to 50° C. to produce a cold sheet (cold steel sheet). The cooling rate from the heating-holding temperature to Ms point−(minus 50°) C may be 0.1° C./s to 200° C./s. During cooling to the Ms point−50° C., the transformation to the martensite phase or/and bainite phase and the precipitation of the aluminum nitride are almost completed. The cooling method is not particularly limited, and may be any of water cooling, aqueous solution cooling, air-water cooling, oil cooling, gas cooling and the like. The cooling rate affects the density and size of the aluminum nitride precipitated inside the laths of the martensite or bainite phase and along the dislocation lines. If the cooling rate is too high, the precipitated aluminum nitride is too small to provide a function as nucleation sites for C-carbide precipitates in the tempering step described later, so that the cooling rate is desirably 200° C./s or less, preferably 100° C./s or less, and more preferably 50° C./s. On the other hand, if the cooling rate is less than 0.1° C./s, the transformation to the martensite phase or/and the bainite phase is insufficient and an excessive ferrite phase is produced, so that the cooling rate is desirably 0.1° C./s or higher, preferably 0.2° C./s or higher, and more preferably 0.5° C./s or higher. The Ms points of steel sheets can be calculated using an empirical formula derived from known Ms points and the chemical compositions. They may also be determined by measuring the thermal expansion curves in a laboratory.

In the next tempering step, for example, a cold sheet quenched to room temperature below 50° C. is inserted into a preheated furnace and is held at a tempering temperature between 100° C. or higher and lower than 300° C. for 60 seconds or more and 900 seconds or less, thereby ε-carbide is precipitated inside the steel sheet (steel). If the holding time is less than 60 seconds, the temperature distribution of the steel sheet is inevitably significantly non-uniform, and as a result, the precipitation of ε-carbide becomes non-uniform, and the high strength and excellent hydrogen embrittlement resistance characteristic of the steel sheet are not guaranteed. If the holding time is 900 seconds or more, the mutual distance between the ε-carbide precipitates increases owing to the Ostwald ripening mechanism, which deteriorates the precipitation strengthening effect.

The ε-carbide precipitates have a size of 2 nm or more and 150 nm or less, and its distribution density is $1\times10^6$ particles/$mm^2$ or more. When the tempering temperature is less than 100° C., the size of the ε-carbide is smaller than 2 nm. Then, the effect of the precipitation strengthening is small, and the hydrogen embrittlement resistance characteristic becomes insufficient. When the tempering temperature is 300° C. or higher, the ε-carbide precipitates start to dissolve in the martensite phase or/and the bainite phase, which is the matrix phase, and disappears even if the steel contains Si. Accompanying it, cementite, which is inferior in strength and toughness, is newly precipitated. Consequently the high strength and excellent hydrogen embrittlement resistance characteristic of the steel sheet are impaired. The tempering temperature is preferably 120° C. to 280° C., and more preferably 150° C. to 250° C.

In the above, the case in which the method for manufacturing the steel according to the mode 2 is applied to a steel sheet (or plate) has been described. However, the present invention is not limited to a steel sheet and can also be applied to steels having various shapes such as shaped steel and steel bar.

According to the modes 1 and 2, it is possible to produce a steel excellent in both tensile strength and hydrogen embrittlement resistance characteristic. The steel does not suffer from delayed fracture due to the intrusion of hydrogen, thereby increasing the long-term reliability of the steel member. According to the modes 1 and 2, the amount of steel used can be reduced. Therefore, emission of greenhouse gases would be decreased in the steel-making process and decreased also by [the consequent reduction of the weight of] running vehicles. These advantages would contribute to an easing of global environmental problems.

Hereinafter, examples will be described with reference to tables. TABLE 1 shows the component composition (chemical composition) and the Ms point of each steel type (steel). TABLE 2 shows the steel type (steel), heating temperature, holding time period, cooling rate, tempering temperature and tempering time period, the size and density of C-carbide, YS, TS, EL, and delayed fracture resistance of each sample (specimen).

TABLE 1

| STEEL TYPE | COMPONENT COMPOSITION (mass %) C | Si | Mn | P | S | Al | N | OTHER ADDITIVE ELEMENT | Ms (° C.) | REMARKS |
|---|---|---|---|---|---|---|---|---|---|---|
| A | 0.151 | 1.72 | 1.03 | 0.005 | 0.007 | 0.038 | 0.002 | | 442 | EXAMPLE |
| B | 0.178 | 1.20 | 1.21 | 0.009 | 0.003 | 0.039 | 0.003 | | 427 | EXAMPLE |
| C | 0.221 | 1.26 | 1.40 | 0.010 | 0.002 | 0.034 | 0.003 | B: 0.003 | 403 | EXAMPLE |
| D | 0.228 | 1.52 | 2.48 | 0.007 | 0.002 | 1.024 | 0.003 | Ti: 0.059 | 367 | EXAMPLE |
| E | 0.348 | 2.48 | 0.89 | 0.008 | 0.004 | 1.953 | 0.004 | Nb: 0.035 | 364 | EXAMPLE |
| F | 0.187 | 1.82 | 1.57 | 0.009 | 0.006 | 0.041 | 0.003 | Cr: 0.33 | 408 | EXAMPLE |
| G | 0.191 | 1.37 | 1.52 | 0.010 | 0.008 | 0.037 | 0.003 | | 412 | EXAMPLE |
| H | 0.297 | 2.61 | 1.53 | 0.009 | 0.002 | 0.039 | 0.003 | | 367 | COMPARATIVE EXAMPLE |
| I | 0.245 | 2.33 | 1.29 | 0.008 | 0.007 | 0.056 | 0.004 | V: 0.05 | 396 | EXAMPLE |
| J | 0.231 | 2.24 | 1.44 | 0.007 | 0.007 | 0.037 | 0.003 | Cu: 0.15 | 398 | EXAMPLE |
| K | 0.218 | 0.18 | 1.73 | 0.006 | 0.003 | 1.210 | 0.004 | | 394 | COMPARATIVE EXAMPLE |
| L | 0.198 | 0.83 | 1.69 | 0.008 | 0.006 | 0.024 | 0.003 | Mo: 0.12 | 403 | EXAMPLE |
| M | 0.349 | 2.05 | 2.11 | 0.007 | 0.006 | 1.862 | 0.004 | Ni: 0.33 | 321 | EXAMPLE |
| N | 0.359 | 2.01 | 1.63 | 0.007 | 0.007 | 0.064 | 0.003 | | 337 | COMPARATIVE EXAMPLE |
| O | 0.216 | 2.37 | 0.74 | 0.009 | 0.005 | 0.069 | 0.003 | | 425 | COMPARATIVE EXAMPLE |
| P | 0.229 | 2.18 | 2.63 | 0.007 | 0.006 | 0.028 | 0.003 | | 362 | COMPARATIVE EXAMPLE |
| Q | 0.191 | 1.37 | 1.52 | 0.010 | 0.009 | 2.059 | 0.004 | | 412 | COMPARATIVE EXAMPLE |
| R | 0.142 | 1.72 | 1.03 | 0.005 | 0.007 | 0.038 | 0.002 | | 448 | COMPARATIVE EXAMPLE |

TABLE 2

| SAMPLE | STEEL TYPE | HEATING TEMPERATURE (° C.) | HOLDING TIME PERIOD (s) | COOLING RATE (° C./s) | TEMPERING TEMPERATURE (° C.) | TEMPERING TIME PERIOD (s) | ε-CARBIDE SIZE (nm) | ε-CARBIDE DENSITY ($\times 10^6$/mm$^2$) |
|---|---|---|---|---|---|---|---|---|
| A-1 | A | 900 | 240 | 20 | 200 | 120 | | |
| B-1 | B | 900 | 240 | 20 | 75 | 120 | | |
| B-2 | B | 900 | 120 | 20 | 150 | 120 | | |
| B-3 | B | 900 | 240 | 20 | 200 | 120 | 70 | 50 |
| B-4 | B | 900 | 240 | 20 | 250 | 120 | 100 | 20 |
| B-5 | B | 900 | 240 | 20 | 350 | 120 | ε-CARBIDE DISSOLVES and DISAPPEARS, CEMENTITE APPEARS | |
| C-1 | C | 880 | 240 | 50 | 200 | 120 | | |
| C-2 | C | 880 | 240 | 500 | 175 | 120 | LESS THAN 2 | UNABLE TO COUNT DUE TO POOR CONTRAST |
| D-1 | D | 880 | 240 | 50 | 175 | 120 | | |
| D-2 | D | 880 | 240 | 0.1 | 175 | 120 | | |
| D-3 | D | 880 | 240 | 0.05 | 175 | 120 | 1150 | 0.5 |
| E-1 | E | 870 | 240 | 50 | 200 | 120 | | |
| F-1 | F | 900 | 240 | 10 | 200 | 120 | | |
| G-1 | G | 900 | 240 | 20 | 200 | 120 | | |
| H-1 | H | 900 | 240 | 50 | 200 | 120 | | |
| I-1 | I | 900 | 240 | 50 | 200 | 120 | | |
| J-1 | J | 900 | 240 | 20 | 250 | 120 | | |
| K-1 | K | 900 | 240 | 30 | 300 | 120 | | |
| L-1 | L | 900 | 240 | 50 | 200 | 120 | | |
| M-1 | M | 900 | 240 | 30 | 200 | 120 | | |

TABLE 2-continued

| | | | | | | |
|---|---|---|---|---|---|---|
| N-1 | N | 900 | 240 | 30 | 200 | 120 |
| O-1 | O | 900 | 240 | 30 | 200 | 120 |
| P-1 | P | 900 | 240 | 30 | 180 | 120 |
| Q-1 | Q | 900 | 240 | 30 | 200 | 120 |
| R-1 | R | 900 | 240 | 30 | 200 | 120 |

| SAMPLE | YS (MPa) | TS (MPa) | EL (%) | DELAYED FRACTURE RESISTANCE | REMARKS |
|---|---|---|---|---|---|
| A-1 | 1108 | 1209 | 18.3 | ○ | EXAMPLE |
| B-1 | 906 | 1090 | 17.5 | X | COMPARATIVE EXAMPLE |
| B-2 | 1116 | 1235 | 17.7 | ○ | EXAMPLE |
| B-3 | 1287 | 1360 | 18.1 | ◎ | EXAMPLE |
| B-4 | 1269 | 1311 | 17.9 | ◎ | EXAMPLE |
| B-5 | 918 | 1016 | 6.3 | X | COMPARATIVE EXAMPLE |
| C-1 | 1255 | 1360 | 18.6 | ◎ | EXAMPLE |
| C-2 | 829 | 1056 | 16.8 | X | COMPARATIVE EXAMPLE |
| D-1 | 1308 | 1633 | 19.5 | ◎ | EXAMPLE |
| D-2 | 1187 | 1240 | 19.0 | ○ | EXAMPLE |
| D-3 | 912 | 1027 | 18.7 | X | COMPARATIVE EXAMPLE |
| E-1 | 1120 | 1358 | 16.2 | ◎ | EXAMPLE |
| F-1 | 1283 | 1372 | 15.6 | ◎ | EXAMPLE |
| G-1 | 1348 | 1437 | 17.7 | ◎ | EXAMPLE |
| H-1 | 1028 | 1246 | 7.8 | ○ | COMPARATIVE EXAMPLE |
| I-1 | 1466 | 1604 | 17.6 | ◎ | EXAMPLE |
| J-1 | 1307 | 1522 | 14.4 | ◎ | EXAMPLE |
| K-1 | 848 | 1093 | 9.3 | X | COMPARATIVE EXAMPLE |
| L-1 | 1137 | 1416 | 17.2 | ◎ | EXAMPLE |
| M-1 | 1482 | 1730 | 16.1 | ◎ | EXAMPLE |
| N-1 | 1557 | 1627 | 4.9 | ○ | COMPARATIVE EXAMPLE |
| O-1 | 1039 | 1123 | 8.3 | X | COMPARATIVE EXAMPLE |
| P-1 | 1230 | 1458 | 8.1 | ○ | COMPARATIVE EXAMPLE |
| Q-1 | 1312 | 1394 | 4.0 | ○ | COMPARATIVE EXAMPLE |
| R-1 | 927 | 1029 | 10.4 | X | COMPARATIVE EXAMPLE |

Note that the following examples are merely examples, and do not limit the present invention. The condition of the examples is demonstrated by one conditional example adopted for confirming feasibilities and effects of the present invention. In the present invention, various conditions can be adopted if the object of the present invention is achieved without deviating from the technical concept and claims of the invention.

A steel plate with a thickness of 30 mm obtained by melting a steel type having the component compositions (chemical compositions) shown in TABLE 1 is reheated to 1250° C., and then hot-rolled to a sheet 3.0 mm thick at a finishing temperature of 950° C., thereby a hot rolled sheet was produced. After the hot-rolled sheet was finish-rolled, it was air-cooled to 600° C.; and then cooled to a temperature of 100° C. or lower. After pickling the cooled hot-rolled sheet, cold-rolling was performed to produce a cold-rolled sheet having a sheet thickness of 1.4 mm. Then, under conditions (heating temperature, holding temperature, cooling rate, tempering temperature, tempering time) shown in TABLE 2, the cold-rolled sheets were annealed, cooled, and tempered to obtain steel sheets (steel). Then, the microstructure evaluations, tensile and delayed fracture tests of the steel sheets related to each specimen were performed. TABLE 2 shows the test results (YS, TS, EL, delayed fracture resistance) of each specimen of the steel sheets.

Here, in TABLE 2, the heating temperature is the heating temperature at the time of annealing, the holding temperature is a holding time at the time of annealing, and the cooling rate is the average cooling rate from the holding temperature to the temperature of Ms point minus 50° C.

[Tensile Test]

From the steel sheets related to each specimen, JIS No. 5 test pieces the longitudinal direction of which was perpendicular to the rolling direction were chosen. They were subjected to a tensile test in conforming to JIS Z 2241 (1998). TABLE 2 shows the yield strength (YS: Yield Stress), the tensile strength (TS: Tensile Strength), and the elongation (EL: Elongation). Here, steel sheets are considered as having a high strength in those cases in which YS≥1000 MPa, TS≥1200 MPa, and EL≥12%.

[Delayed Fracture Test]

A 100 mm×30 mm test piece the longitudinal direction parallel of which was perpendicular to the rolling direction was chosen and subjected to U-shaped bending deformation with a bending radius of 10 mm, and then the spring-back portion was stress-loaded by tightening with a bolt and nut (see NPL 7). The test piece was immersed in a 0.1% ammonium thiocyanate solution at 25° C. The delayed fracture resistance after the processing was evaluated until the time of fracture (here, surface microcrack) which was observed at the end face of the U-bending test piece. The 0.1% ammonium thiocyanate solution can introduce hydrogen into the test piece while extremely reducing the dissolution of the test piece during the immersion test. When immersed in the 0.1% ammonium thiocyanate solution for 500 hours the test piece was not fractured, its delayed fracture characteristic was judged very good (◎). When immersed for 100 hours the test piece was not fractured, and thus its delayed fracture characteristic was judged good (○), and when the test piece was fractured, its delayed fracture characteristic was judged inferior (X).

In the remarks column of TABLE 2, a specimen (sample) is described as EXAMPLE when the specimen (sample) showed YS≥1000 MPa, TS≥1200 MPa, EL≥12%, and its delayed fracture characteristic was very good or good, while the other specimens (samples) are described as COMPARATIVE EXAMPLEs. Further, in the remarks column of TABLE 1, the steel type is described as EXAMPLE if at least one specimen (sample) made of the same particular steel type is described as EXAMPLE in TABLE 2. The other steel types are described as COMPARATIVE EXAMPLEs.

To confirm that the excellent delayed fracture resistance shown in TABLE 2 is due to the ε-carbide, a pair of specimens with the steel type D in TABLE 1 were prepared. Their chemical compositions and experimental conditions including the final quenching are the same. One of them was not subjected to any tempering and it is named as a non-tempered specimen. The other is a tempered specimen which was given a tempering treatment at 200° C. Electron-microscopic observation has revealed that only the tempered specimen contains the precipitates of ε-carbide. Both specimens were immersed in a 0.1% ammonium thiocyanate solution at 25° C. for 100 hours to introduce hydrogen into the specimens. Then, the hydrogen evolution (discharge) rate was measured for each specimen while raising the specimen temperature. The results are shown in FIG. 1. In the non-tempered specimen (broken line) in which ε-carbide has not precipitated, there is an evolution peak ranging from room temperature to 50° C. up to 100° C. The evolution peak in this temperature region has been conventionally attributed to the desorption of hydrogen atoms captured at the lath interfaces, dislocation lines or the interfaces between carbonitrides and the steel matrix. In the tempered specimen (solid line) in which the ε-carbide has been precipitated, a large evolution peak appears at 300° C. to 400° C. This temperature range coincides with the temperature range in which ε-carbide dissolves [decomposes] in the steel microstructure to form cementite. If hydrogen atoms are occluded firmly in the ε-carbide, they will not be released to the exterior of the specimen until the temperature at which the crystal of the ε-carbide becomes unstable. The strong peak is evidence of the large amount of hydrogen occluded in the specimen. In the steel according to the present invention, intruding hydrogen atoms are stably occluded inside the ε-carbide precipitates which are dispersedly distributed in the martensite phase or/and the bainite phase during the tempering, and thus the allowable amount of intruding hydrogen atoms is-remarkably large. The steels according to the present invention are capable of being stably used in environments exposed to hydrogen up to temperatures of about 200° C.

In the present application, it has been shown that ε-carbide composed of iron and carbon, both of which are the basic elements of steels, can be dispersedly precipitated to produce a steel having high strength and excellent hydrogen embrittlement resistance characteristic without expensive rare [metal] elements. The presence of ε-carbide in steels was discovered in the 1940s. However, it has been practically ignored as a transient carbide in the Fe—C phase diagram. The name has merely been listed at the end of iron carbide class as a superordinate category in domestic and foreign patent documents. Even if it happened to be a subject of basic research, its technical and industrial value was never explored. However, at the beginning of the 21st century the U.S. Air Force Headquarters in Eglin, Florida, developed a military steel called "Eglin Steel". It satisfies both high strength and high toughness required as a warhead material for underground penetrating bombs with small content of alloying elements. Later, an electron-microscopic observation has revealed that dispersedly precipitated ε-carbide contributes to the high strength and high toughness around room temperature. This steel has become a target of research interest together with the ε-carbide among some research groups in the US. This has led to the invention of special steels for general use with high strength and toughness utilizing ε-carbide (PTL3). However, the steel has the drawbacks that it requires a special melting furnace and complicated heat treatments. The inventor of the present application happened first to notice this trend of steel research when he submitted the manuscript of NPL1 to a journal issued in the US. It is an objective of the present invention to manufacture a general-purpose steel having both high strength (and high toughness) and excellent hydrogen embrittlement resistance characteristic, based on a novel and unique concept, by full use of advanced steel-making technology in Japan. Its technical ripple effect will be great.

After filing the Japanese application for the present application, the source (original) paper of NPL2 by T.G.O. Berg cited in [0014] became available as a copy (NPL8). This original Berg paper was not available at the time of drafting the Japanese application because the libraries were locked out due to the world-wide spread of COVID-19. NPL8 (orally publicized in 1959 and later published in 1961) is the parent document (mother paper) of NPL2 (published in 1962). Detailed examination of NPL8 has disclosed that Berg's experiment was very incomplete as an experiment of crystal chemistry. Furthermore, in 1973, the carbide envisioned by Berg was finally determined to be $Fe_5C_2$ by X-ray diffraction experts, a carbide with a crystal structure totally different from the hexagonal ε-carbide. Based on these reasons, it is concluded that Berg did not deal with, nor did he discuss the ε-carbide. These historical situations have been recently published as a part of a research paper by the inventor of the present application (published on Feb. 23, 2021, Reference 1). The entire contents thereof shall be incorporated in this application by way of reference.

[Reference 1] Michio Shimotomai, "Heuristic Design of Advanced Martensitic Steels That Are Highly Resistant to Hydrogen Embrittlement by ε-carbide" Metals, 2021, 11 (2): 370. https://doi.org/10.3390/met11020370

Further, each disclosure of Patent Literatures and Non-Patent Literatures cited above is incorporated herein in its entirety by reference thereto and can be used as a basis or a part of the present invention as needed. It should be noted that it is possible to modify or adjust the example embodiments or examples within the scope of the whole disclosure of the present invention (including its Claims and the Drawing) based on the basic technical concept thereof. Further, it is possible to variously combine or select (or deselect if necessary) a wide variety of the disclosed elements (including the individual elements of the individual claims, the individual elements of the individual example embodiments or examples, and the individual elements of the individual FIGURES) within the scope of the whole disclosure of the present invention. That is, it is selfexplanatory that the present invention includes any types of variations and modifications capable of being done by a skilled person according to the whole disclosure including the Claims and the Drawing, and the technical concept of the present invention. Particularly, any numerical values or ranges disclosed herein should be interpreted in such a manner that any intermediate or lower values or subranges falling within the disclosed ranges are also concretely disclosed even without specific recital thereof. In addition, the use of using some or all of the disclosed elements in each literature reference cited above as necessary in combination with the elements described herein as part of the disclosure of the present invention in accordance with the object of the present invention shall be considered to be included in (or belonging to) the disclosed elements of the present application.

The invention claimed is:

1. A steel, having a chemical composition consisting of: in mass %,

C: 0.15% to 0.35%;
Si: 0.8% to 2.5%;
Mn: 0.8% to 2.5%;
Al: 0.03% to 2.0%;
N: 0.002% to 0.010%;
P: 0.01% or less;
S: 0.01% or less;
O: 0.01% or less;
B: 0.0001% to 0.005%;
Nb: 0.0% to 0.05%;
Ti: 0.0% to 0.2%;
V: 0.0% to 0.05%;
Mo: 0.0% to 1.0%;
Cr: 0.0% to 1.0%;
Ni: 0.01% to 1.0%;
Cu: 0.05% to 1.0%;
at least one of Ca, Mg and REM (rare earth metals): 0.0005% to 0.01%; and the balance being Fe and impurities, wherein the steel has a martensite phase or/and a bainite phase in which ε-carbide having a size of 2 nm or more to 150 nm or less is dispersedly precipitated at a density of $1\times10^6$ or more per 1 $mm^2$, and wherein the ε-carbide has a hexagonal crystal structure containing hydrogen trapping carbon vacancy sites inside a crystal grain thereof, the hydrogen trapping carbon vacancy sites being stable from 0° C. to about 300° C., and wherein the steel is substantially free of cementite.

2. The steel according to claim 1, wherein at least one of the Nb, the Ti and the V has a mass % greater than 0%, and wherein at least one of the Mo and the Cr has a mass % greater than 0%.

3. The steel according to claim 1, wherein the chemical composition of the steel has a ratio of Al to N in mass % of more than 7 or at least 10.

4. The steel according to claim 1, wherein, in volume fraction, the martensite phase or/and the bainite phase exist(s) 70% or more and less than 90%.

5. The steel according to claim 4, wherein, in volume fraction, a residual austenite phase exists 5% or more and less than 30%, and other phase(s) containing at least ferrite exists less than 20%.

6. The steel according to claim 1, wherein the steel has a thermal desorption spectrum having a second peak in a temperature range of 300° C. to 400° C. as compared to a first peak appearing around 100° C., the second peak being caused by one or both of: desorption of hydrogen stably trapped by the hydrogen trapping carbon vacancy sites in the ε-carbide and transformation thereof over an entire thermal desorption spectrum ranging from 0° C. to 400° C.

7. The steel according to claim 1, wherein the ε-carbide has substantially no hydrogen trapping after heating at 400° C. detectable with a thermal desorption spectrum.

8. The steel according to claim 1, wherein the steel is substantially free of cementite in a temperature range of from 0° C. to about 300° C.

* * * * *